US005819501A

United States Patent [19]

Albrecht et al.

[11] Patent Number: 5,819,501

[45] Date of Patent: Oct. 13, 1998

[54] APPARATUS FOR MANIPULATING FLAPS OF PACKETS FOR PRODUCTS OF THE TABACCO PROCESSING INDUSTRY

[75] Inventors: Peter Albrecht; Frank Bley; Reinhard Deutsch; Josef Glösmann, all of Hamburg, Germany

[73] Assignee: Topack Verpackungstechnik GmbH, Schwarzenbek, Germany

[21] Appl. No.: 978,994

[22] Filed: Nov. 26, 1997

[30] Foreign Application Priority Data

Dec. 13, 1996 [DE] Germany ..... 196 51 874.1

[51] Int. Cl.[6] ..... B65B 11/06

[52] U.S. Cl. ..... 53/226; 53/372.5; 53/575; 131/285

[58] Field of Search ..... 131/285; 53/226, 53/443, 372.5, 575, 447

[56] References Cited

U.S. PATENT DOCUMENTS

| | | | |
|---|---|---|---|
| 5,150,562 | 9/1992 | Araki et al. | 53/438 |
| 5,168,690 | 12/1992 | Quadrana | 53/575 |
| 5,588,281 | 12/1996 | Boriani et al. | 53/443 |

FOREIGN PATENT DOCUMENTS

| | | | |
|---|---|---|---|
| 953205 | 12/1949 | France | 131/285 |
| 985185 | 3/1965 | United Kingdom | 131/285 |

*Primary Examiner*—John G. Weiss
*Assistant Examiner*—Charles W. Anderson
*Attorney, Agent, or Firm*—Spencer & Frank

[57] ABSTRACT

A machine wherein block-shaped arrays of cigarettes are confined in envelopes having closed ends and open ends located at the adjacent end faces of the confined arrays. Each open end includes two confronting elongated flaps alternating with narrow tucks which are to be folded against the adjacent end face of the confined array ahead of the flaps. Successive envelopes are delivered onto a platform constituting the bottom wall of a receptacle and being movable from a lower level, in which the receptacle receives an envelope, to an upper level in which it delivers the finished envelope into a pocket at the underside of an indelible turntable. The tucks of an envelope on the platform are folded over the adjacent end face of the confined array by two folding elements which are movable in a horizontal plane. The flaps are held against deformation by mobile confining elements and the upper panel of the envelope adjacent the upper flap is held against bulging by a pivotable back support which overlies the envelope adjacent its open end during folding of the tucks.

10 Claims, 6 Drawing Sheets

APPARATUS FOR MANIPULATING FLAPS OF PACKETS FOR PRODUCTS OF THE TABACCO PROCESSING INDUSTRY

BACKGROUND OF THE INVENTION

The invention relates to packing machines for arrays of cigarettes or other rod-shaped smoker' products. More particularly, the invention relates to improvements in apparatus which are designed to carry out certain stages of the making and closing of envelopes around arrays of rod-shaped articles or the like (hereinafter also called blocks, packets or commodities).

Arrays of cigarettes (e.g., arrays of twenty cigarettes in the so-called quincunx formation with two outer layers of seven articles each flanking a median layer of six articles) are often confined in envelopes of metallic foil or the like prior to being introduced into packets, e.g., into cardboard packets known as hinged lid packs. As a rule, the envelopes are converted blanks which are deformed around the respective arrays in such away that one end of the envelope is closed at one end face of the array, that the envelope surrounds the longer sides of the array between the two end faces, and the open end of the array is thereupon confined or concealed by folding two confronting narrow tucks of such open end against the respective end face of the confined array and by thereupon folding the two elongated flaps of such open end over the freshly folded tucks. This completes the confinement of an array in the envelope and the thus confined array is then ready to be introduced into a hinged lid pack or into any other suitable receptacle (such as a soft pack).

The present invention more particularly relates to improvements in apparatus which can serve to close the open ends of successive envelopes by folding the tucks ahead of the respective flaps.

It is already known to fold two tucks at the open end of an envelope for a block-shaped array of smoker' products while the envelope and its contents are supported by a vertically movable platform which serves to receive successive envelopes while being located at a lower level and which thereupon moves to a higher level to thus deliver an envelope into one of an annulus of pockets at the underside of an indexible turntable in a cigarette packing machine. A drawback of heretofore known apparatus for folding the tucks at the open ends of envelopes for arrays of cigarettes or the like is that such folding operation can entail an undesirable deformation of the adjacent portions of the open end of the envelope, and this can affect the appearance of the ultimate product and can also interfere with predictable continuation of the envelope closing and subsequent packet forming operations.

OBJECTS OF THE INVENTION

An object of the invention is to provide a simple, compact and reliable apparatus which can be utilized in packing machines to predictably and neatly fold the tucks and the flaps at the open ends of envelopes for confined arrays of cigarettes or other block-shaped commodities.

Another object of the invention is to provide a packing machine which embodies one or more tuck and flap folding apparatus of the above outlined character.

A further object of the invention is to provide a novel and improved method of manipulating the tucks and the flaps at the open ends of envelopes for essentially block-shaped arrays of cigarettes or other commodities.

An additional object of the invention is to provide an apparatus which can be incorporated into presently known cigarette packing and other packing machines as a superior substitute for presently available tuck and flap folding apparatus.

Still another object of the invention is to provide novel and improved tuck- and flap-folding instrumentalities for use in the above outlined apparatus.

A further object of the invention is to provide the improved apparatus with novel and improved envelope guiding and confining components.

Another object of the invention is to provide the above outlined apparatus with novel and improved means for preventing undesirable deformation of other parts during the folding of tucks and/or flaps at the open ends of the envelopes.

An additional object of the invention is to provide a novel and improved method of making hinged lid packs of plain or filter cigarettes or other rod-shaped articles of the tobacco processing industry.

SUMMARY OF THE INVENTION

One feature of the invention resides in the provision of apparatus for folding pairs of confronting lateral tucks forming part of open end portions of successive envelopes of a series of envelopes confining block-shaped commodities of the tobacco processing industry which have end faces at the open end portions of the respective envelopes. The apparatus comprises a a platform having an upper side arranged to support discrete envelopes so that the open end portion of the envelope on the platform is accessible. The platform is located beneath and is movable up and down between raised and lowered positions relative to an indexible turntable having an underside provided with pockets each arranged to receive an envelope in response to upward movement of the platform. The apparatus further comprises folding elements movable against the tucks of an envelope which is carried by the platform in the lowered position of the platform to fold the respective tucks against the end face of the commodity within the envelope on the platform, and a back support arranged to overlie the envelope on the platform at the open end portion of such envelope at least during folding of the tucks by the respective folding elements.

The folding elements are or can be pivotable relative to the platform, preferably about at least substantially vertical axes. Such folding elements preferably flank the platform.

The back support can be borne by a guide which is pivotable relative to the platform, preferably in an at least substantially horizontal plane.

The platform can constitute the bottom wall of a receptacle for discrete envelopes, and such receptacle is preferably provided with an open upper side confronting the turntable. Furthermore, the receptacle is preferably provided with an open front or rear side or end for admission of envelopes into the receptacle, i.e., onto the platform.

The apparatus can further comprise confining elements which flank a portion of the path for introduction of successive envelopes into the receptacle; such confining elements can include first and second confining elements which are respectively disposed above and below the aforementioned portion of the path for delivery of successive envelopes into the receptacle.

The novel features which are considered as characteristic of the invention are set forth in particular in the appended claims. The improved apparatus itself, however, both as to its construction and the mode of assembling and installing the same in a packing machine for cigarettes or the like, together with numerous additional important and advantageous features thereof, will be best understood upon perusal of the following detailed description of certain presently preferred specific embodiments with reference to the accompanying drawings.

DESCRIPTION OF PREFERRED EMBODIMENTS

Figure 1:
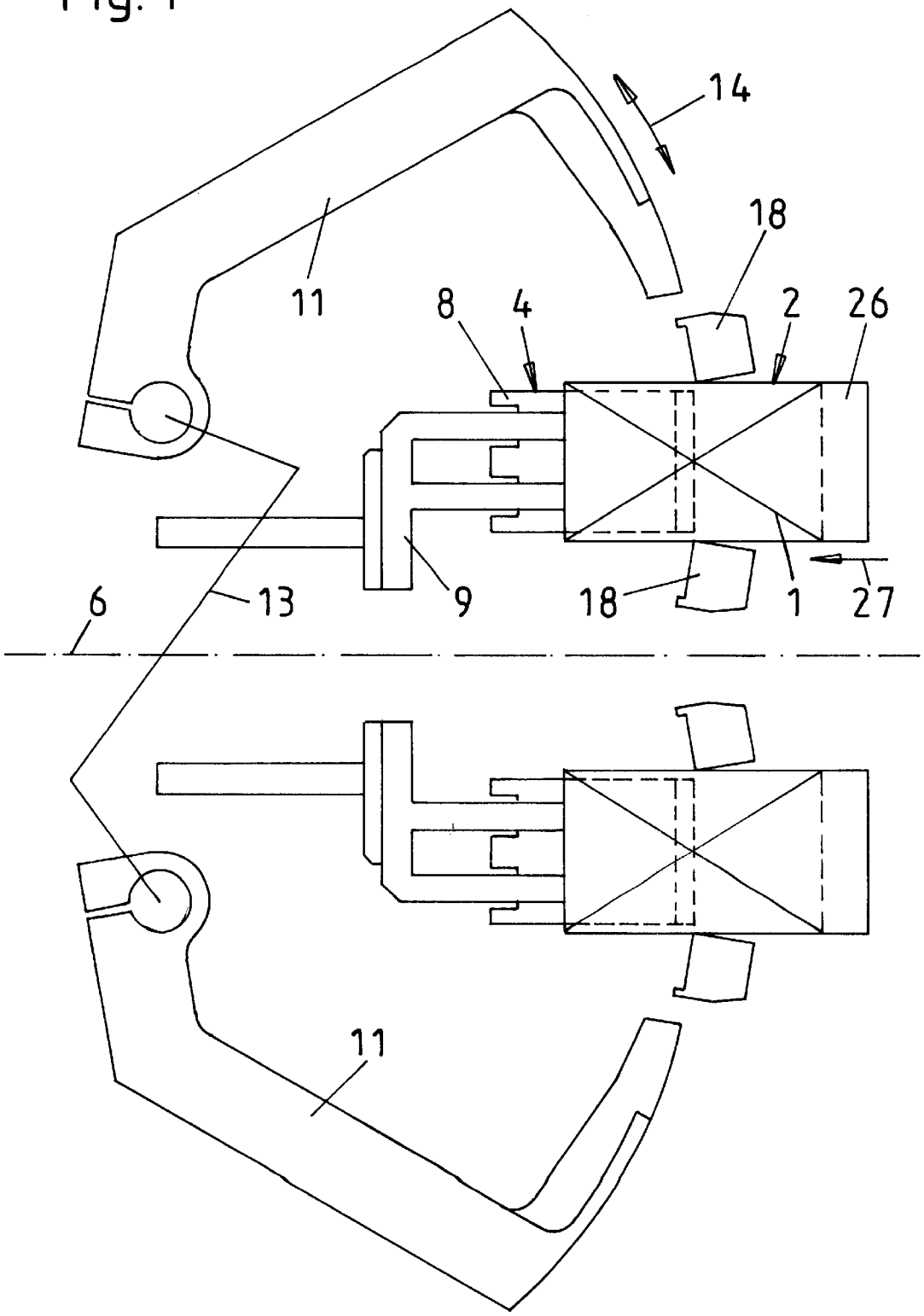
FIG. 1 is a fragmentary schematic plan view of a portion of a cigarette packing machine embodying two apparatus which are constructed and assembled and operate in accordance with a presently preferred embodiment of our invention.
Figure 2:
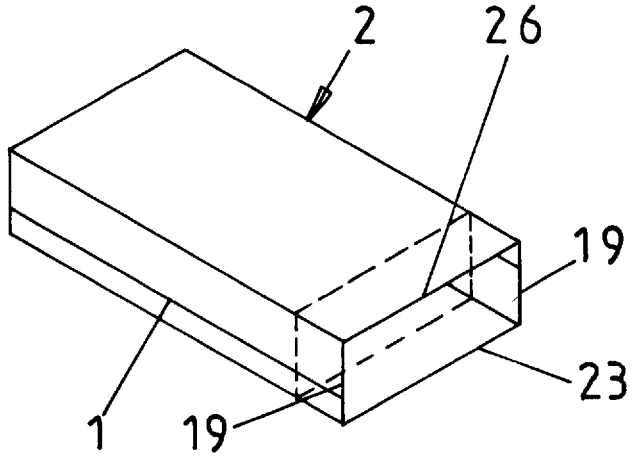
FIG. 2 is a perspective view of an envelope and a block-shaped commodity therein, with the open end of the envelope in a condition it assumes prior to treatment in the improved apparatus.

FIG. 1 is a plan view of a portion of a machine for the simultaneous making of two series of cigarette packets. Those portions of the machine which are shown in FIG. 1 have instrumentalities for folding the so-called tucks 19 (see FIG. 2) at the open end or end portion of an envelope 1 which contains a block-shaped commodity 2. The latter can constitute an array of, for example, twenty plain or filter cigarettes (not specifically shown) which are to be fully confined in an envelope 1 consisting of metallic foil (e.g., aluminum foil) preparatory to introduction into a cardboard box such as a hinged lid pack. Alternatively, each commodity 2 can constitute a so-called soft pack or a hard pack which is to be confined in a customary envelope of transparent plastic material.

Figure 3:
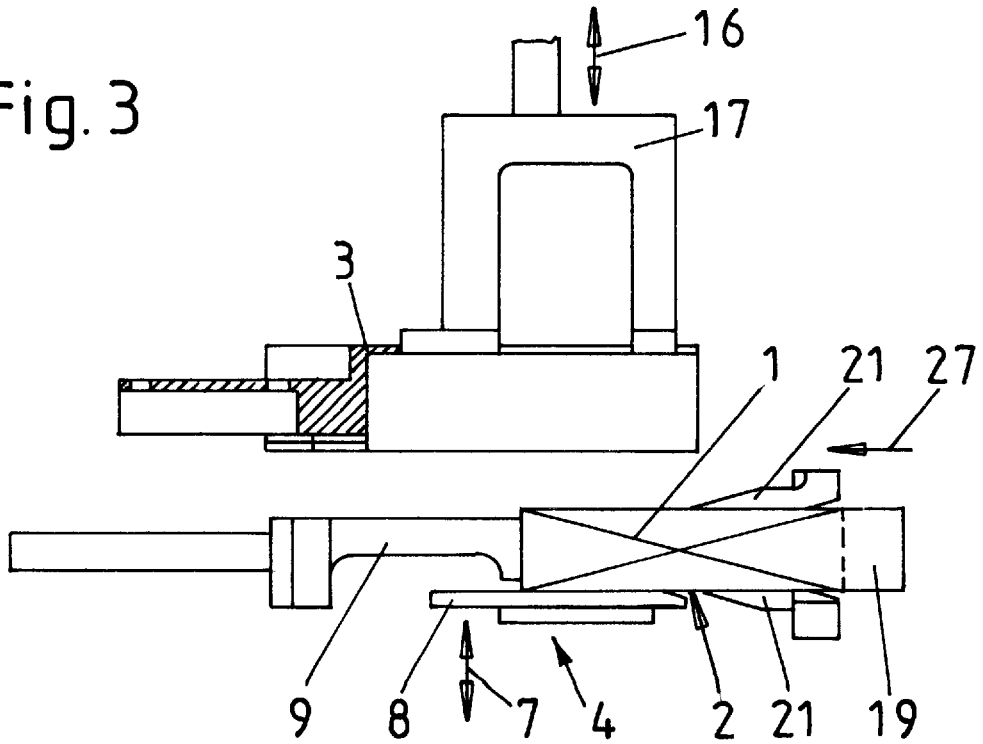
FIG. 3 is a fragmentary partly side elevational and partly sectional view of one of the two apparatus of FIG. 1, with the parts of the apparatus in positions they assume during introduction of an envelope (in a condition as shown in FIG. 2) into a receptacle of the apparatus.
Figure 7:
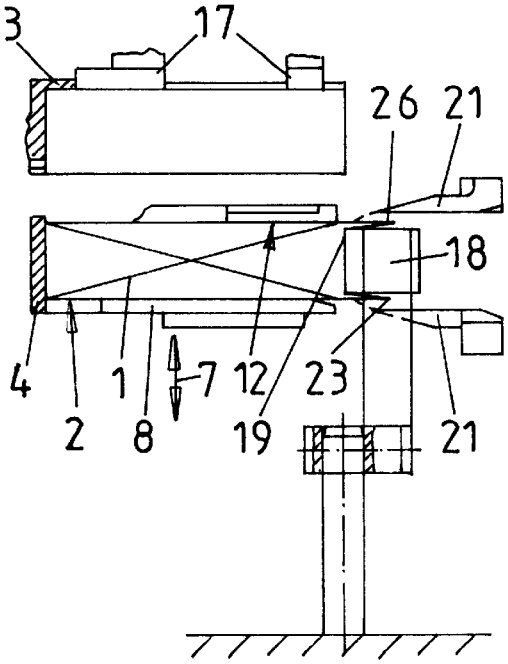
FIG. 7 is a side elevational view of the structure of FIG. 6 and further showing the indelible turntable above the receptacle.
Figure 15:
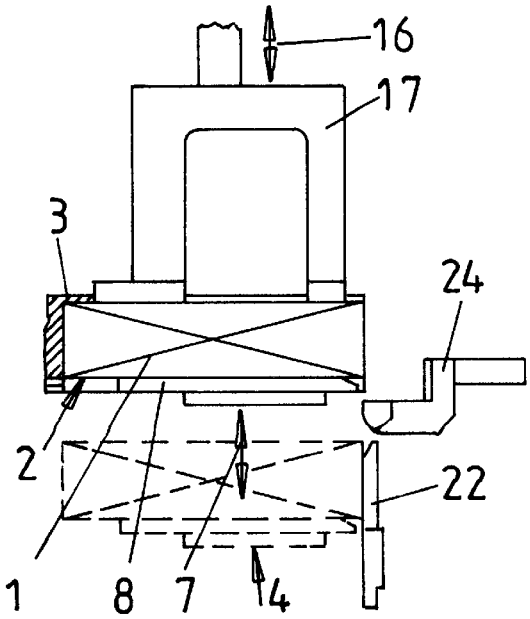
FIG. 15 shows the structure of FIG. 14 upon completed lifting of the envelope into a pocket of the turntable, the positions of certain parts prior to lifting of the platform being indicated by broken lines.

Since the two halves of the machine a portion of which is shown in FIG. 1 are exact mirror images of each other (with reference to a vertical plane indicated in FIG. 1 by a dot-dash line 6), only one of these halves (apparatus) will be described in full detail. As can be seen in FIG. 7, each apparatus comprises a turntable which is indexible about a vertical axis and the underside of which is provided with an annular array of radially extending pockets 3 (only one shown in FIG. 7) each dimensioned to receive a block 2 and its envelope 1 during dwell at a level above a receptacle 4. The latter comprises a bottom wall 8 which serves as an envelope supporting (or carrying) and lifting platform and is movable up and down (as indicated by a double-headed arrow 7) between a lower level (shown in FIG. 3) at which it receives an envelope arriving in a direction and along a preferably horizontal path indicated by an arrow 27, and an upper level (FIG. 15) to thus introduce the envelope into the registering pocket 3 at the underside of the turntable. The latter can be designed and mounted to receive envelopes from each of the two apparatus shown in FIG. 1.

The upper side of the receptacle 4 is open, the same as its front or rear side (namely the right-hand side, as viewed in FIG. 7), so that an envelope 1 can enter the receptacle along the aforementioned preferably horizontal path in the direction indicated by the arrow 27 and can leave the receptacle (to be taken over by and to remain in the then registering pocket 3 of the turntable), by way of the open upper side. The rear or front side (i.e., the left-hand side, as viewed in FIGS. 1 or 3) of the receptacle 4 is provided with two openings (not specifically shown) for the prongs of a reciprocable pusher 9 which abuts the closed end of an envelope 1 and yields during introduction of such envelope in the direction of the arrow 27. The pusher 9 can control the speed of advancement of an envelope 1 (and of the block 2 therein) into the receptacle 4 (i.e., onto the upper side of the platform 8) but it can also perform other functions not germane to the present invention.

When the platform 8 assumes its lower end position at the lower level (see, for example, FIGS. 3 and 7), it is spaced apart from the registering pocket 3 at the underside of the turntable. This provides room for an abutment or back support 12 (FIG. 5) which is pivotable about a vertical axis and has an underside arranged to overlie the upper side of an envelope 1 adjacent the open end to thus prevent undesirable deformation of the envelope during folding of the tucks 19 against the adjacent end face of the block 2 in such envelope. FIG. 1 shows schematically a mechanism 13 which serves to pivot the guides or holders 11 for the two back supports 12 in synchronism with the movements of the respective platforms 8 to thus ensure that the two envelopes 1 then resting on such platforms are simultaneously engaged adjacent their open ends to guarantee that the upper flaps 26 of the envelopes are held against deformation and/or undesirable shifting while the tucks are being folded against the end face of the respective block 2. At the same time, the lower flap 23 can abut the upper side of a lower confining element 21 so that this flap, too, is prevented from shifting and/or from undergoing deformation during folding of the tucks 19. The directions of pivotal movements of one of the abutments or back supports 12 with the respective guide 11 shown in FIG. 1 are indicated by a double-headed arrow 14.

The means for engaging and displacing the tucks 19 of an envelope 1 while the latter rests on the platform 8 and is being confined by the underside of the respective back support 12 includes a pair of folding elements 18 which flank the respective platform 8 and are pivotable toward and away from each other in a horizontal plane including the tucks 19 which are to be folded relative to the respective flaps 23, 26, and against the adjacent end face of the respective block 2.

Figure 14:
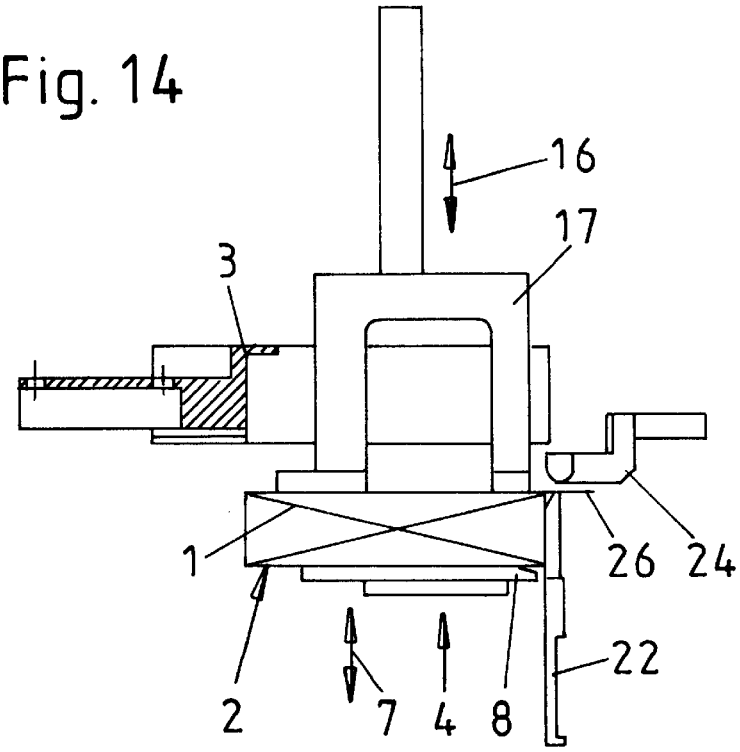
FIG. 14 is a partly side elevational and partly sectional view of the apparatus with its parts in the positions they assume subsequent to folding of the lower flap and preparatory to lifting of the platform of the receptacle in order to transfer the envelope from the receptacle into a pocket of the indexible turntable.

A stop 17 above the path of each platform 8 is installed for up-and-down movements indicated by a double-headed arrow 16 to cooperate with the respective platform 8 during lifting of an envelope from the receptacle 4 into the registering pocket 3 of the turntable (see FIG. 14). The prongs of the stop 17 above the platform 8 can extend downwardly through the adjacent pocket 3.

Figure 6:
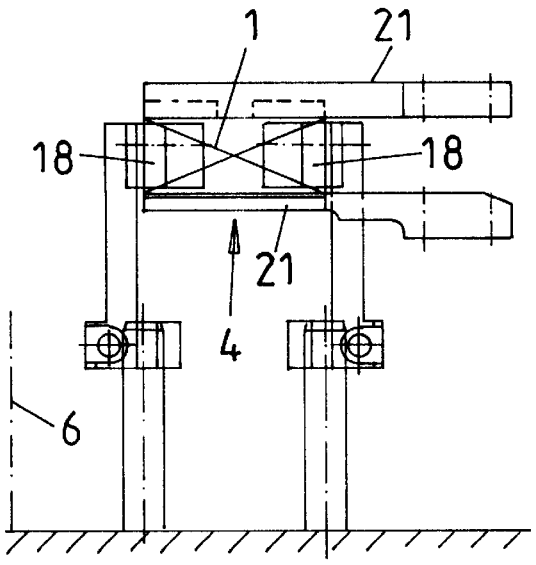
FIG. 6 is a view as seen from the right-hand side of FIG. 5 and shows the folding elements for the tucks at the open end of the envelope in the receptacle in the positions they assume upon completion of the folding operation.

Each apparatus comprises two confining elements 21 one of which is located above and the other of which is located beneath a portion of the path for advancement of an envelope onto the respective platform 8. As can be seen in FIGS. 6 and 7, the confining elements 21 flank the adjacent portion of the path for the envelopes 1 into the receptacle 4.

A lower folding element 22 (FIGS. 14 and 15) is movable up and down relative to an envelope 1 which is properly confined in the respective receptacle 4 to thus pivot the lower elongated flap 23 over the freshly folded tucks 19, and a stationary folding element 24 (FIGS. 14 and 15) is located or can be moved adjacent the path for upward movement of an envelope 1 with the respective platform 8 toward and into the then registering pocket 3 to thus fold the upper elongated flap 26 over the freshly folded lower flap 23. This completes the closing of the previously open end or end portion of the envelope 1, and the turret can be indexed to advance the pocket 3 with a freshly received and finished envelope 1 therein to the next processing station, e.g., to a station where the envelope 1 and its block 2 are introduced into a suitable soft or hard pack.

The operation of an apparatus (above or below the symmetry plane 6 of FIG. 1) is as follows:

As shown in FIGS. 1 to 5, an envelope 1 (with a block 2 already confined therein) is advanced in the direction of the arrow 27 so that its closed end is leading (i.e., the open end or end portion including the two tucks 19 and the two flaps 23, 26 can be said to constitute the trailing end or end portion of the envelope). Such movement of the envelope 1 and the block 2 therein is effected by a plunger (not shown) which bears upon the end face of the block 2 within the confines of the open end of the envelope 1 and maintains the closed end of the envelope in contact with the two prongs of the pusher 9 which yields at the rate at which the plunger advances the envelope along the upper side of the platform 8 and into the receptacle 4. The envelope 1 advances between the upper and lower confining elements 21 (see particularly FIG. 3). Thus, the pusher 9 cooperates with the confining elements 21, with the platform 8 (still in the lower end position) and with the plunger to ensure a predictable introduction of the envelope 1 and of its block 2 into the receptacle 4.

Figure 4:
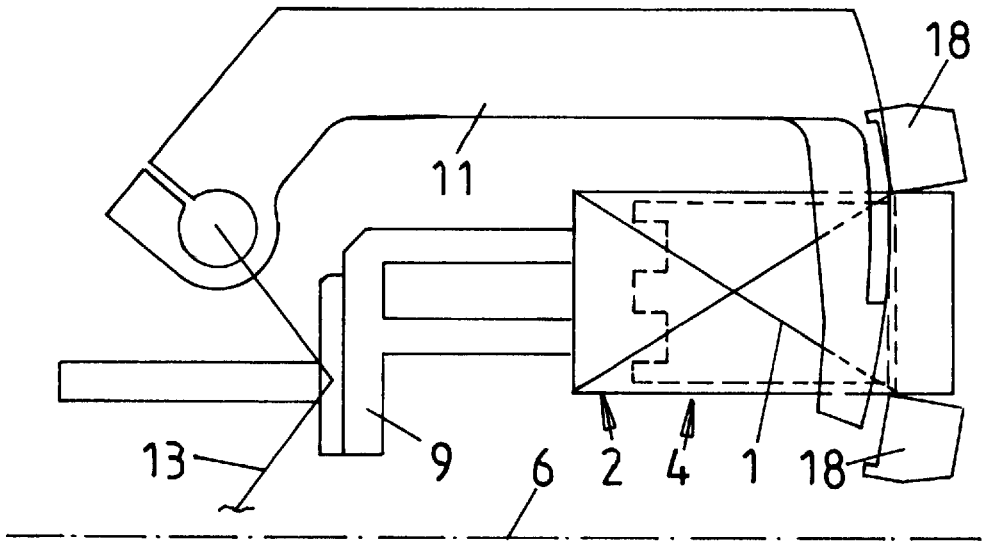
FIG. 4 is a plan view of the structure which is shown in FIG. 3 but with the back support moved to a position in which it overlies a portion of the envelope in the receptacle.
Figure 5:
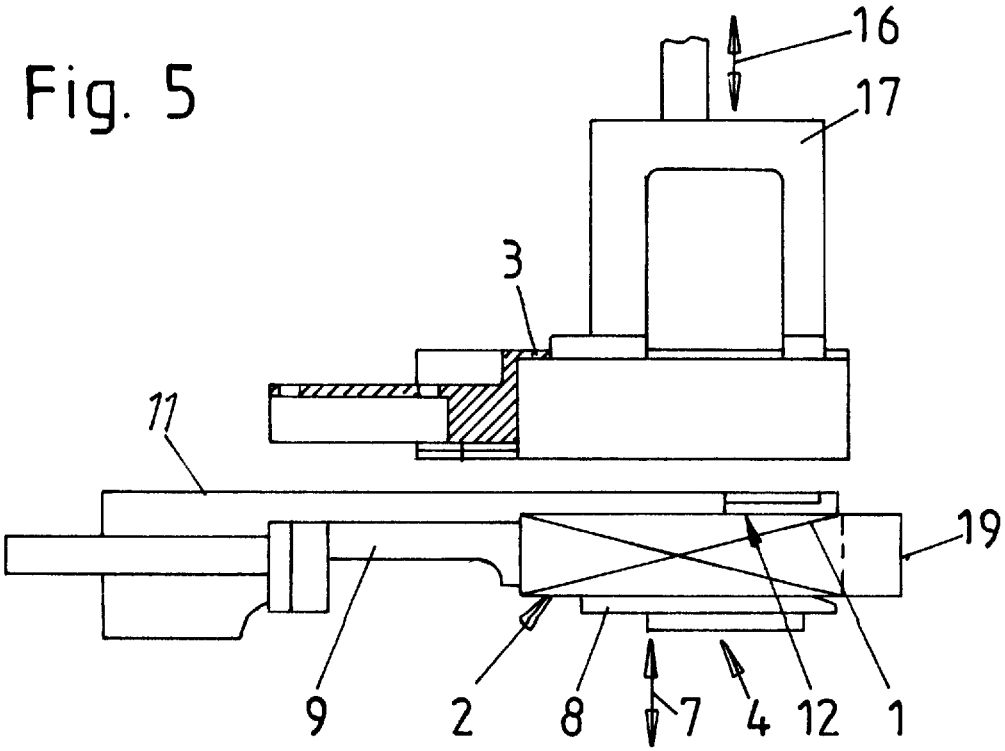
FIG. 5 is a view similar to that of FIG. 3 but showing the back support in a position corresponding to that shown in FIG. 4 and with two confining elements for the flaps at the open end of the envelope in the receptacle omitted or retracted.

The guide 11 is pivoted from the position of FIG. 1 to the position of FIG. 4 or 5 during advancement of the envelope 1 into the receptacle 4 so that the back support 12 of the guide overlies the upper side of the envelope 1 immediately or closely in front of the upper flap 26 when the envelope reaches its final (optimum) position in the receptacle. The guide 11 (and more specifically the transversely extending free end portion or back support 12 of this guide) is then closely or immediately adjacent (it is held in front of) the upper confining element 21.

Figure 8:
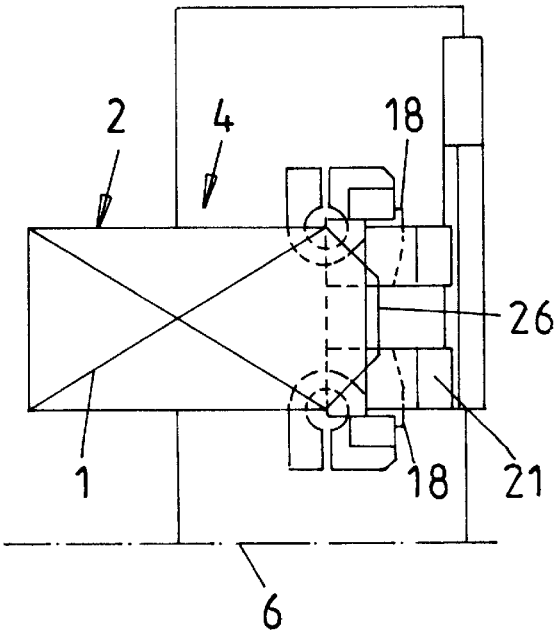
FIG. 8 is a plan view of the structure which is shown in FIG. 6.
Figure 9:
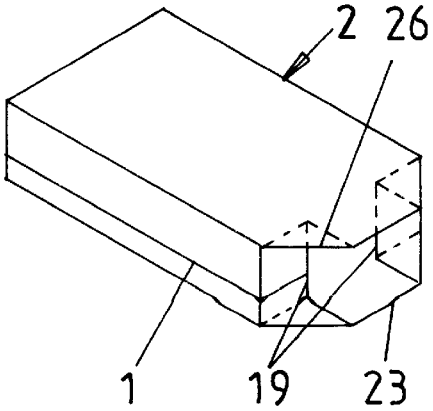
FIG. 9 shows the envelope in a perspective view similar to that of FIG. 2 but subsequent to folding of the tucks at the open end of the envelope.

The next stage of operation of the improved apparatus is shown in FIGS. 6 to 8. The first stage involves a relatively small retraction of the confining elements 21 (compare FIGS. 3 and 7), and the subsequent stage involves pivoting of the folding elements 18 so that the two tucks 19 are pivoted relative to the flaps 23, 26 and against the end face of the block 2 in the envelope 1. At such time, the underside of the lower flap 23 overlies the lower confining element 21 adjacent the rear edge of the platform 8, and the upper side of the upper flap 26 is overlapped by the upper confining element 21. The underside of the back support 12 overlies the upper side of the envelope 1 in front of the flap 26. When this (folding) step (by the elements 18) is completed, the envelope 1 assumes the shape which is shown in FIG. 9.

Figure 10:
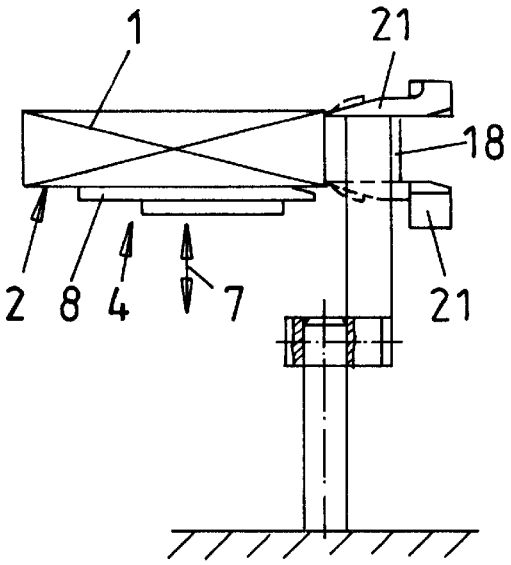
FIG. 10 shows a portion of the structure shown in FIG. 7 but with the confining elements in different positions relative to the envelope in the receptacle.
Figure 11:
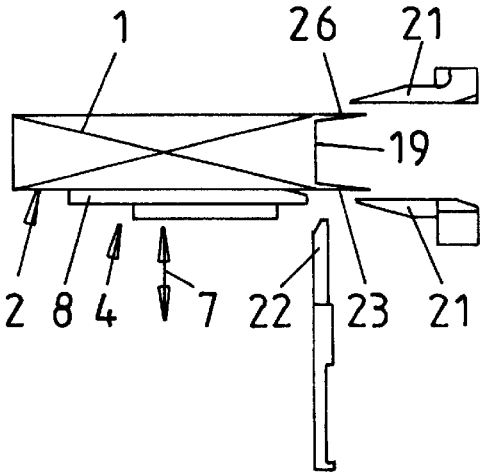
FIG. 11 shows the structure of FIG. 10 but with the confining elements in retracted positions to provide room for a vertically reciprocable element which serves to fold the lower flap at the open end of an envelope in the receptacle over the folded tucks.
Figure 12:
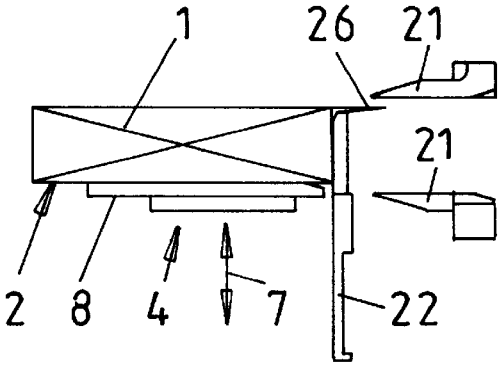
FIG. 12 shows the structure of FIG. 11 but with the folding element for the lower flap in a position it assumes upon completion of the folding step.
Figure 13:
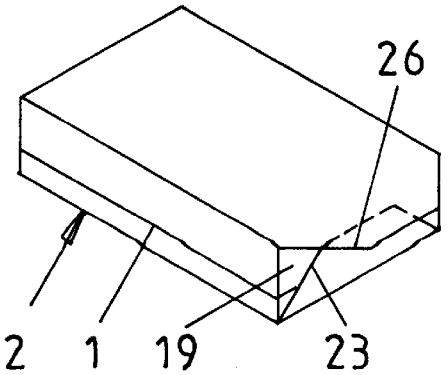
FIG. 13 shows the envelope in a perspective view similar to that of FIG. 9 but subsequent to folding of the lower flap over the previously folded tucks.

As shown in FIG. 10, the confining elements 21 can actually contact the outer sides of the respective flaps 23, 26 during folding of the tucks 19 by the respective folding elements 18. The next step then involves lifting and retraction of the confining elements 21 (compare FIGS. 10 and 11) so that the lower confining element 21 provides room for a lifting of the folding element 22 which folds the lower flap 23 against the outer sides of the already folded tucks 19 (see FIG. 12). This stage of closing of the trailing (previously open) end or end portion of the envelope 1 is shown in FIG. 13.

Figure 16:
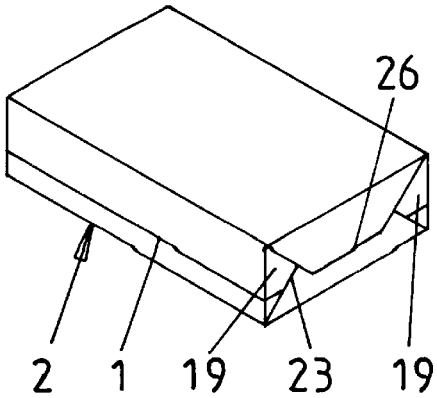
FIG. 16 shows the envelope in a perspective view similar to that of FIG. 13 but with the upper flap folded over the previously folded lower flap.

When the folding step by the element 22 is completed, the back support 12 is returned into or already assumes the retracted position of FIG. 1. This enables the member 17 to descend to the position of FIG. 14 and to thereupon move upwardly with the ascending platform 8 (see FIG. 15) in order to transfer the envelope 1 (in the condition as shown in FIG. 13) from the receptacle 4 into the registering pocket 3 of the turntable. This enables the stationary element 24 to fold the flap 26 over the already folded flap 23 so that, when it enters the pocket 3, the envelope 1 assumes the shape which is shown in FIG. 16, i.e., the previously open end or end portion is closed in a highly predictable and eye-pleasing manner.

An important advantage of the improved apparatus is that the folding elements 18, 18, 22, 24 are enabled to establish relatively sharp creases or fold lines between the elongated panels and the folded tucks 19, 19 and flaps 23, 26 of the finished (closed) envelope. This is attributable to the desirable effect of the underside of the pivotable back support 12, to the influence of the confining elements 21, and to accurate guidance of the envelopes 1 by the platform 8, the pusher 9, the aforementioned plunger, the abutment or back support 12 and the confining elements 21 during introduction into the receptacle 4. The platform 8 cooperates with the member 17 to ensure a predictable guidance of successive envelopes 1 of a short or long series of such envelopes from the receptacle 4 into the registering pocket 3 of the indexible turntable in the packing machine which embodies the improved apparatus.

Another important advantage of the improved apparatus is that the back support 12 cooperates with the platform 8 and with the confining elements 21 to reliably prevent any buckling, arching, bulging and/or other stray movements of the flaps 23, 26 and of the adjacent portions of an envelope during folding of the tucks relative to the respective pivotable folding elements 18.

The improved apparatus can be installed in existing cigarette packing machines or in other types of packing machines.

The exact manner of synchronizing the movements of the mobile parts 8, 9, 12, 17, 21, 22 and 24 in the afore described sequence to carry out the various steps or operations in the required order forms no part of the present invention. Such synchronization is well known to the persons possessing the required skill in the art of making packing machines for plain or filter cigarettes or other products of the tobacco processing industry.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of packing machines for cigarettes or the like and, therefore, such adaptations should and are intended to be comprehended within the meaning and range of equivalence of the appended claims.

What is claimed is:

1. Apparatus for folding pairs of confronting lateral tucks forming part of open end portions of successive envelopes of a series of envelopes confining substantially block-shaped commodities which have end faces at the open end portions of the respective envelopes, comprising a platform having an upper side arranged to support discrete envelopes so that the open end portion of the envelope on the platform is accessible, said platform being located beneath and being movable up and down between raised and lowered positions relative to an indexible turntable having an underside provided with pockets each arranged to receive an envelope in response to upward movement of said platform; folding elements movable against the tucks of an envelope carried by said platform in said lowered position of the platform to fold the respective tucks against the end face of the commodity within the envelope on said platform; and a back support arranged to overlie the envelope on said platform at said open end portion of such envelope during folding of the tucks by said folding elements.

2. The apparatus of claim 1, wherein said folding elements are pivotable relative to said platform.

3. The apparatus of claim 2, wherein said folding elements are pivotable about substantially vertical axes and flank said platform.

4. The apparatus of claim 1, wherein said back support is borne by a guide which is pivotable relative to said platform.

5. The apparatus of claim 4, wherein said guide is pivotable in a substantially horizontal plane.

6. The apparatus of claim 1, wherein said platform constitutes a bottom wall of a receptacle for discrete envelopes.

7. The apparatus of claim 6, wherein said receptacle has an open upper side confronting said turntable.

8. The apparatus of claim 7, wherein said receptacle has an open front side for delivery of envelopes onto said platform.

9. The apparatus of claim 6, further comprising confining elements flanking a portion of a path for introduction of successive envelopes into said receptacle.

10. The apparatus of claim 9, wherein said confining elements include first and second confining elements respectively disposed above and below said portion of said path.

* * * * *